United States Patent [19]

Kreutz et al.

[11] 4,213,528

[45] Jul. 22, 1980

[54] PACKAGE FOR ACID CONTAINER

[75] Inventors: George D. Kreutz, Dallas; L. J. Scott, Lewisville; James P. Kelly, Arlington, all of Tex.

[73] Assignee: Becton Dickinson & Company, Paramus, N.J.

[21] Appl. No.: 942,049

[22] Filed: Sep. 13, 1978

[51] Int. Cl.[2] ..... B65D 81/26; B65D 85/84

[52] U.S. Cl. ..... 206/205; 206/524.3; 206/524.4; 220/408; 206/204

[58] Field of Search ..... 206/204, 446, 594, 524.3, 206/524.4, 205, 524.5; 312/36, 45, 72; 220/408

[56] References Cited

U.S. PATENT DOCUMENTS

| | | | |
|---|---|---|---|
| 1,408,757 | 3/1922 | Metzger | 206/204 |
| 2,348,622 | 5/1944 | Heilman | 206/524.3 |
| 3,061,549 | 10/1962 | Dickey | 206/524.4 |
| 3,101,839 | 8/1963 | Halman | 206/524.2 |
| 3,462,027 | 8/1969 | Puckhaber | 206/594 |
| 3,999,653 | 12/1976 | Haigh | 206/594 |

*Primary Examiner*—Herbert F. Ross
*Attorney, Agent, or Firm*—Louis E. Marn; Elliot M. Olstein

[57] ABSTRACT

A package for an acid container, such as an acid containing ampule or bottle, formed of an acid resistant envelope and a separate removable absorbent shield for enclosing the acid container, with the absorbent shield including a material to neutralize acid whereby any acid released from the container is absorbed and neutralized by the absorbent shield.

15 Claims, 1 Drawing Figure

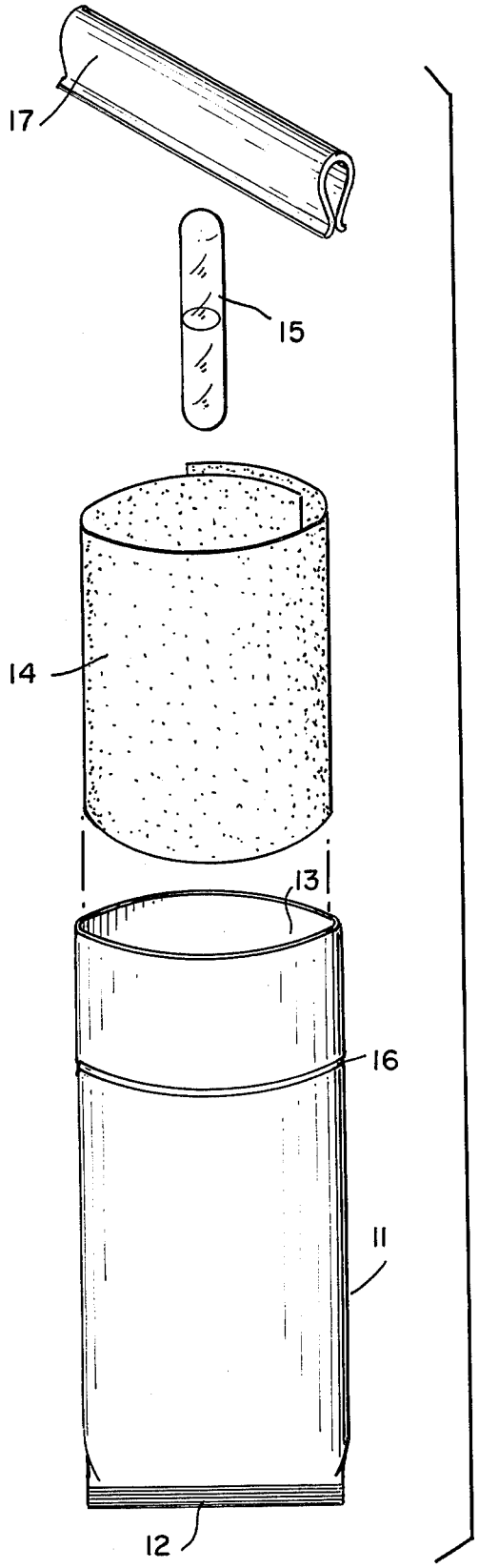
17
15
14
13
16
11
12

PACKAGE FOR ACID CONTAINER

This invention relates to a package of an acidic substance, and more particularly to a package for an acid container.

In accordance with the present invention there is provided a package for an acid container comprised of an acid resistant envelope for the acid container and a separate removable absorbent shield for enclosing the acid container, with the absorbent shield being permeated with a material to neutralize acid whereby any acid released from the container within the envelope is absorbed and neutralized by the absorbent shield.

The acid neutralizing absorbent shield functions to trap, absorb and hold any and all acid liberated upon leakage or breakage of the acid container within the envelope, and to neutralize (partially or completely) such liberated acid.

The absorbent shield is generally porous, yet sufficiently absorbent to allow essentially instantaneous absorption of acidic liquids of high, medium and low viscosities; e.g., concentrated sulfuric acid, concentrated nitric acid, and dilute acetic acid, respectively.

The absorbent material is also sufficiently stable to retain an acid neutralizing substance; i.e., the absorbent material is not adversely affected by the acid neutralizing substance. As representative examples of absorbent materials which can be utilized in the present invention, there may be mentioned absorbent paper; e.g., blotter paper, non-woven fabrics, plastic, rubber, synthetic or natural foams, etc. The selection of a suitable absorbent material is deemed to be well within the scope of those skilled in the art from the teachings herein.

The acid neutralizing substance may be any substance which is effective for neutralizing the acid present in the container upon leakage thereof from the aid container into the envelope. The acid neutralizing substance is preferably one which does not produce a gaseous neutralization product to prevent an increase in pressure within the envelope; however, in cases where excess interior pressure can bleed off, the acid neutralizing substance can be one which yields upon reaction with leaked acid a gaseous neutralization product. The acid neutralizing substance can be any one of a wide variety of bases, either organic or inorganic, and as representative examples, there may be mentioned: metal hydroxides, such as potassium hydroxide, sodium hydroxide, lithium hydroxide, and the like; metal carbonates; amines, and chemically similar substances. The selection of a suitable basic material for effecting neutralization of leaked acid is deemed to be well within the scope of those skilled in the art from the teachings herein.

The acid neutralizing substance is incorporated into the absorbent shield by impregnating the absorbent material with the neutralizing substance in any manner consistent with the properties of the neutralizing substance. For example, the absorbent material may be completely or partially saturated with an alcoholic or aqueous solution of a metallic hydroxide, such as KOH, and the solvent evaporated.

The envelope for the acid container is formed of an acid resistant material, which is preferably an acid resistant plastic in sheet or film form. As representative examples of suitable materials, there may be mentioned; polyvinyls, polyethylene, polycarbonate, polypropylene, with polyethylene generally being preferred.

The package of the present invention is particularly suitable for small acid containers in the form of, for example, glass ampules, bottles, etc.

The acid neutralizing absorbent material may take any one of a wide variety of forms which permits the absorbent material to wrap around; i.e., completely enclose or envelop the acid container. In accordance with the present invention, the acid neutralizing absorbent shield is a separate entity which can be removed from the envelope whereby it is possible for the acid containing container to be present within the envelope in the absence of the absorbent acid neutralizing shield. This offers the advantage that the acid resistant envelope can be employed as a test container, after removal of the absorbent acid neutralizing shield; i.e., the acid container can be broken or emptied so that the acid content thereof passes into the envelope, now free of the absorbent acid neutralizing shield, whereby a procedure requiring the acid can be effected in such envelope.

The invention will be further described with respect to the accompanying drawing wherein:

The drawing is a simplified representation of an embodiment of of the package of the present invention.

Referring now to the drawing, there is shown an acid resistant envelope 11, for example, of polyethylene, having a sealed end 12 and and open end 13.

The envelope 11 is adapted to hold an acid neutralizing absorbent shield 14, formed, for example, from blotter paper and having incorporated therein as an acid neutralizing substance potassium hydroxide, and a sealed glass ampule 15 containing an acidic liquid.

As particularly shown, the acid neutralizing absorbent shield is in the form of a flat sheet which is adapted to be wrapped around the glass ampule; however, such acid neutralizing absorbent shield may take other forms. Thus, for example, the acid neutralizing absorbent sheet may be in the form of a preformed tube, globe or cube.

As particularly shown, the glass ampule, containing the acidic liquid, is inserted into the open end 13 of envelope 11 along with the acid neutralizing shield 14 in a manner such that the ampule is wrapped within such shield. The envelope 11 is then folded along line 16, and the open end 13 thereof includes means for sealing and opening the envelope, such as a removable closure member, in the form of removable clip 17. The acid neutralizing absorbent shield 14 is of a length such that upon folding of the envelope 11 along fold line 16 the top and bottom of the tube formed from the shield 14 wrapped around the ampule 15 is effectively closed by the external pressure exerted by the bottom construction and top construction of the envelope 11, when the open end 13 thereof is closed by the closure member 17. Other forms of absorbent neutralizing material may be used which more fully and completely enclose the acid container.

In accordance with the embodiment, the acid neutralizing absorbent shield 14 may be effectively removed from the envelope 11 without the necessity of removing the ampule 15, whereby the ampule 15 can be broken within the envelope 11 for use in a testing procedure. For example, the acid may be employed for testing for an illicit drug by procedures known in the art. In such a procedure the suspected illicit drug is introduced into the test envelope after removal of the shield and the envelope resealed. The acid ampule is broken by finger pressure to initiate the test procedure.

It is to be understood that various modifications of the embodiment are possible within the scope of the invention. Thus, for example, the ampule may be pre-wrapped within the acid neutralizing absorbent shield and/or pre-sealed therein, whereby it would be necessary to remove both the ampule and absorbent shield from the envelope, followed by re-insertion of the ampule within the envelope.

These and other modifications should be apparent to those skilled in the art from the teachings herein.

The present invention is particularly advantageous in that it eliminates the potential dangers resulting from leakage of acids from an acid container into a package therefor. In addition, the present invention provides a package which can be easily transported without danger of leakage from the package and which further provides a testing container for a test employing an acid. Thus, the present invention provides a suitable package for a field test which requires the use of an acidic material.

Numerous modifications and variations of the present invention are possible in light of the above teachings and, therefore, within the scope of the appended claims, the invention may be practiced otherwise than as particularly described.

We claim:

1. A package for an acid container, comprising:

an acid resistant envelope and test container for an acid container whereby acid can be released from an acid container into the envelope for use in a procedure in the envelope and a separate removable absorbent shield within the envelope for enclosing an acid container, said absorbent shield including a material to neutralize acid whereby any acid released from an acid container in the envelope is absorbed and wholly or partially neutralized by said absorbent shield.

2. The package of claim 1 wherein the envelope is a flexible acid resistant material.

3. The package of claim 2 wherein the absorbent sheet is formed of a material selected from the group consisting of absorbent papers, non-woven fabrics, plastic, rubber and synthetic and natural foams.

4. The package of claim 3 wherein said material to neutralize acid is a metal hydroxide.

5. The package of claim 3 wherein the acid resistent envelope is formed from a material selected from the group consisting of polyvinyls, polyethylene, polycarbonates and polypropylene.

6. The package of claim 5 wherein the acid resistent envelope is formed from polyethylene.

7. A package, comprising:

an acid resistant envelope and test container, whereby acid can be released from an acid container into the envelope for use in a procedure in the envelope; an acid container within said envelope, and a separate removable absorbent shield enclosing the acid container, said absorbent shield including a material to neutralize acid whereby any acid released from the acid container in the envelope is absorbed and neutralized by said absorbent shield.

8. The package of claim 7 wherein said envelope includes means for closing and opening the envelope whereby the absorbent shield can be removed from the envelope and acid from the acid container can be released into the envelope for use in a procedure conducted in the envelope.

9. The package of claim 8 wherein the means for closing and opening the envelope comprises a removable clip.

10. The package of claim 8 wherein the envelope is a flexible acid resistant material.

11. The package of claim 10 wherein the absorbent sheet is formed of a material selected from the group consisting of absorbent papers, non-woven fabrics, plastic, rubber and synthetic and natural foams.

12. The package of claim 11 wherein said material to neutralize acid is a metal hydroxide.

13. The package of claim 11 wherein the acid resistent envelope is formed from a material selected from the group consisting of polyvinyls, polyethylene, polycarbonates and polypropylene.

14. The package of claim 13 wherein the acid resistent envelope is formed from polyethylene.

15. The package of claim 13 wherein the acid container is a glass ampule.

* * * * *